US005170711A

United States Patent [19]

Maier et al.

[11] Patent Number: 5,170,711

[45] Date of Patent: Dec. 15, 1992

[54] METHOD AND APPARATUS FOR INK CONTROL AND ZONAL PRESETTING

[75] Inventors: Werner Maier, Augsburg; Gerd Steiner, Heusenstamm; Josef Schneider, Diedorf-Lettenbach, all of Fed. Rep. of Germany

[73] Assignee: Man Roland Druckmaschinen AG, Offenbach am Main, Fed. Rep. of Germany

[21] Appl. No.: 644,617

[22] Filed: Jan. 23, 1991

[30] Foreign Application Priority Data

Feb. 10, 1990 [DE] Fed. Rep. of Germany ..... 4004056

[51] Int. Cl.[5] ..... B41F 31/04; B41F 33/16

[52] U.S. Cl. ..... 101/365; 101/483; 101/217

[58] Field of Search ..... 101/365, 350, 363, 181, 101/DIG. 45, DIG. 47, 483, 211, 217, 218, DIG. 38; 250/559; 358/75, 80

[56] References Cited

U.S. PATENT DOCUMENTS

| | | | |
|---|---|---|---|
| 3,958,509 | 5/1976 | Murray et al. | 101/426 |
| 4,665,496 | 5/1987 | Ott | 101/365 X |
| 4,852,485 | 8/1989 | Brunner | 101/DIG. 45 |
| 4,949,284 | 8/1990 | Watanabe | 101/365 X |
| 5,029,526 | 7/1991 | Kipphan | 101/DIG. 38 |
| 5,031,534 | 7/1991 | Brunner | 101/365 |
| 5,070,784 | 12/1991 | Nishida et al. | 101/365 |

FOREIGN PATENT DOCUMENTS

| | | | |
|---|---|---|---|
| 3334019 | 3/1985 | Fed. Rep. of Germany | 101/211 |
| WO89/07525 | 8/1989 | Int'l Pat. Institute . | |
| 2012213 | 7/1979 | United Kingdom . | |
| 2189744 | 11/1987 | United Kingdom . | |

*Primary Examiner*—J. Reed Fisher

*Attorney, Agent, or Firm*—Frishauf, Holtz, Goodman & Woodward

[57] ABSTRACT

The values ascertained from printer's copies (8, 9), for ink zone presetting, are supplied to a color supply detection computer (3) via a film/plate scanner (4). Before the various scanning areas in accordance with scanning patterns (7) are summed up, the zonal preset values ascertained by the ink supply detection computer (3) undergo a correction in accordance with the value furnished by a weighting computer (16) for each scanning area. This optimizes the presetting of the ink zones. As a function of the corrected values taking the subject to be printed into account, ductor rollers (22) and rubber rollers (21) can be controlled in order to improve the ink penetration as a function of the subject in the circumferential direction as well.

19 Claims, 2 Drawing Sheets

METHOD AND APPARATUS FOR INK CONTROL AND ZONAL PRESETTING

FIELD OF THE INVENTION

The present invention relates to ink control and zonal presetting of ink metering elements in inking mechanisms of rotary printing presses, in particular offset rotary printing presses, in accordance with zonally ascertained area coverage data.

BACKGROUND

The area coverage in inking zones can be ascertained by scanning the subject matter to be printed in a pattern having a scanning area that is narrower than the width of inker zones. A two-dimensional checkerboard-pattern-like detection of the area coverage in each ink zone can be obtained. The ink distribution, in accordance with the values ascertained from said area coverage, then determines the local ink supply within each ink zone in the distribution of the ink application.

It has previously been proposed —see German Patent Disclosure Documents DE-OS 29 50 6060 and 29 50 650 —to scan films or printing plates for their area coverage by ink zones, using optoelectronic measuring instruments. After integration or adding of the scanned values, presetting information for ink metering elements, are calculated for instance for ink control sliders in inking mechanisms of offset rotary printing presses. The scanning elements each sense over the width of an ink zone, and for a printing press of typical size have a size of 5 mm×720 mm. By suitably moving the scanners, or the elements to be scanned, in other words the film or plate, the preset values can be derived for each ink zone from the area coverage of subject matter to be printed. In practice, it has been found that the preset values thus ascertained are not sufficiently accurate, so that expensive readjustments and corrections are necessary, which among other disadvantages lead to increased spoilage and as a result lengthen the printing time required to complete the printing process.

THE INVENTION

It is an object of the present invention to provide a method and an apparatus performing this method to enable exact ascertainment or variation of the preset values for the ink zone and of the local amount of ink required so that the correct amount of ink required for printing will be supplied.

Briefly, the ink metering elements in an inking mechanism of a rotary printing press are preset based on dividing each inker zone into smaller areas than an ink zone of the inker and then to determine the two-dimensional ink coverage required in said zones. Ink is supplied for each zone in accordance with the ink coverage thus determined to be required for reproduction based on sensing the actual required ink coverage, if any, existing in each zone. The ink supply to each of the metering elements is adjusted based on the ink previously supplied to the inking elements and the actual ink coverage sensed in each zone.

The method and apparatus of the present invention provides accurate ink control for small surface components, such as fine structures (half tones, fine lines) and coarse structures (full-tone areas) on the printing form, or film or sheet, respectively, to be printed, which then can be distinguished. Thus, the present invention determines the actual inker zone preset values, and then adjusts these preset values, for example to reflect reduced use of ink in full-tone areas in comparison with half-tone or finely lined areas. These adjustments can be achieved preferably by suitably weighting either the surface components to be printed or the scanning screen.

In accordance with a feature of the present invention, correction factors are provided which can be modified and stored in memory for future use; these correction factors can include the parameter values of the printing process (for example paper, ink, composition of the damper, printing speed, ink penetration characteristics, etc.). Correction can be made by using a self-learning system or an optimizing system.

The present invention makes it possible to adjust for problems in ink acceptance in color printing since the method of the present invention permits the area components of overprinted area components or of successively or overprinted half-tone patterns to be ascertained and adjusted. In the prior art method for detecting the area components to be printed in color printing, the location of the color areas located next to each other or the location of color areas to be printed one above the other could not be distinguished so that it was not possible to adjust for such information and adjust the preset values accordingly. With the method of the present invention, it becomes possible to determine printed areas printed on top of one another in the various colors. From the values determined as a result, it can be determined for the individual ink zone to what extent problems in ink acceptance can be expected. This also permits obtaining ink presetting correction factors which make it possible to optimize ink presetting. For ink control or regulation, knowledge of the existing ink acceptance problems are important, particularly if different inks are to be overprinted. By using correction factors detectable according to the present invention, the dynamics of ink flows can be optimized in individual colors or in ink zones.

Non-uniform inking (striping or ghosting) effects can be eliminated since, in accordance with a feature of the present invention, the potential onset of non-uniform inking can be sensed. Possible stenceling effects can thus be predicted and corrected. The ghosting effects can be corrected by oscillating, reciprocating rollers in the inking mechanism.

The data obtained are based on scanning data for each small area in a zone, thus providing detailed information.

The detected scanning pattern values from the area components to be printed are weighed prior to the completion of summing of the values for print control, and as a result the amount of ink required per ink zone can be optimized by means of appropriate correction factors.

According to a feature of the present invention, detection and evaluation of the location of area components located in line with one another and which are side-by-side with each other can be effected prior to the sum formation per ink zone, and specifically identical positions or locations or scanning patterns in the associated copies used for different colors. Thus correction factors are obtained that have advantages for ink zone presetting or inking control (or regulation). Weighting and calculation of the correction can be effected in a separate computer, or in a computer already present in the machine. In practice, empirically determining the correction factors is often advantageous. These factors are then stored in a memory. The stored correction factors are then used for future scanning sequences, as required.

DRAWINGS

DETAILED DESCRIPTION

Figure 1:
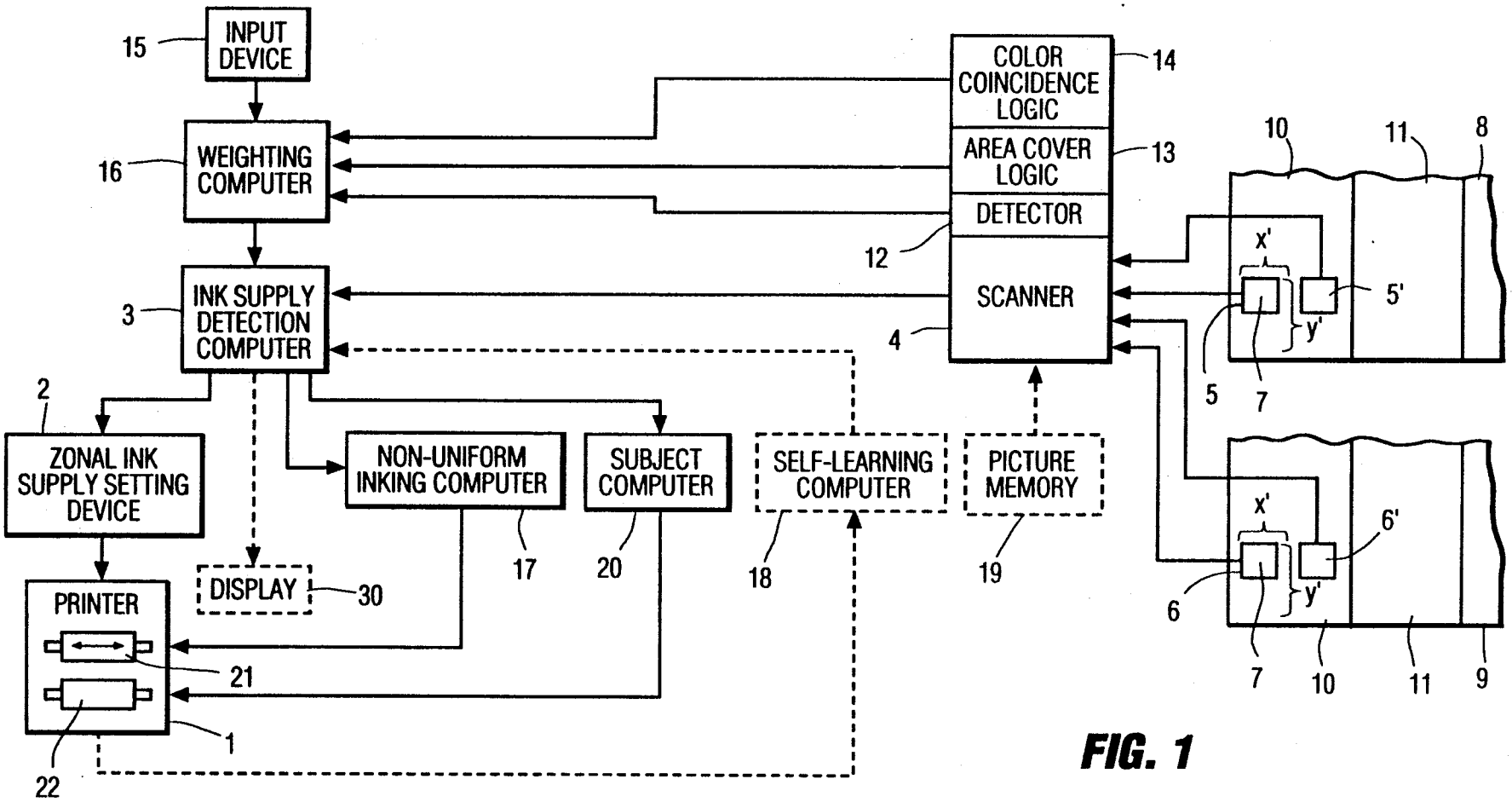
FIG. 1 is a block diagram of an apparatus which operates in accordance with the method of the present invention.

Referring to FIG. 1, a printing press 1, such as an offset rotary printing press, for printing on webs of material, or for printing on sheets, is connected to a known zonal ink supply presetting apparatus 2. Apparatus 2 includes both the electrical and electronic control components and the mechanical components required for zonal presetting of metering elements, such as ink control sliders 3. Connected to the ink zone presetting apparatus 2 is an ink supply detection computer 3. The information as to the ink coverage required in each zone is supplied from a film or plate scanner 4 to ink supply detection computer 3. It will be understood that the values scanned by a film and plate scanner can also be stored in memory in a tape or diskette and the tape or diskette can then be read into the ink supply detection computer 3.

The film or plate scanner 4 is equipped with at least one row of scanners. In FIG. 1, for the sake of simplicity, only two scanners 5,5' and 6,6' for any one color of a scanning pattern, are shown. In accordance with a feature of the present invention, the scanner 5 or 6 is designed, preferably, to detect a scanning pattern surface having a spot size of 2 mm×2.5 mm. As a result, in comparison with the prior art ink zones that are 20 to 60 mm wide in the X direction, a much larger number of side-by-side miniature scanning spots 7 can be detected within one ink zone.

Using the principle on which the invention is based, in contrast to the prior art, the scanner 5 or L is intended to be substantially smaller in the X and Y direction than the ink zone. The evaluation accuracy can be increased using a smaller and finter accuracy of the scanning pattern 7. As mentioned, a preferred size of the scanners 5, 6 is 2.5 mm in the X direction and 2.0 mm in the Y direction. For the sake of simplicity, the scanner 5 or 6 required to detect a scanning pattern 7 is shown only once, but a greater number of such scanners 5, 6 is provided in the form of a line, as seen in the X direction, distributed for instance over the width of an ink zone.

Two printer's copies 8, 9 are shown in FIG. 1; to perform two-color printing, they can be scanned simultaneously or successively. The printer's copies 8, 9 may be either plates or films. Ink zones 10, 11 are indicated on the printer's copies 8, 9; they are scanned in improved or in other words finer resolution in comparison with the prior art, because of the smaller dimensions of the miniature scanning pattern 7, and provide a substantially more exact determination of the ink coverage. It is understood that when the printer's copies 8 and 9 are scanned, only a single row of a plurality of scanner elements 5 needs to be used and that another row of scanner elements 6 can be eliminated if scanning of the printer's copies 8, 9 is done successively. The values detected by the scanners 5 and 6 indicate the ink coverage. The electronics of the film or plate scanner 4 is well known. These values, at the X and Y coordinates being scanned, are simultaneously detected and processed, each by means of one of the scanners 5 (for X and Y) and 6 (for X', Y'), in an X-Y coordinate detecting logic system 12. The values ascertained by the film or plate scanner 4 can be further processed in the area coverage detection logic system 13. A color coincidence detection logic system 14 is also provided to sense the X and Y values of the scanning patterns at the same position for the differently colored copies 8, 9 and then compare them in order to ascertain whether colored areas are to be printed above one another, that is, overprinted. If so, then corresponding correction values that will have an influence on the ink zone presetting have to be determined, in order to compensate for the ink acceptance problems that often occur from superimposed imprinting. The X-Y coordinate detection circuit 12 detects the positions of the particular scanned area 7 which the scanner 4 and scanning heads 5, 6 scan. The values processed in the X-Y coordinate detection logic circuit or system 12, the area coverage detection logic system 13 and the ink coincidence detection logic system 14 are supplied to a weighting computer 16, which includes a weighting memory therein. An input device 15 permits manual entry of correction factors to be entered into computer 16. Calculation of correction factors in computer 16 the individual patterns is also possible.

For each inker zone, and for each scanning pattern, the values supplied to the ink supply calculation computer 3 from a film/plate scanner 4 are corrected if necessary by a correction factor or a correction value provided by the weighting computer 16, before the scanned values are added, in an ink zone for each scanning pattern. The correction factor or value is determined by the weighting computer 16 from the information supplied to it from detector 12, area coverage logic 13 and coincidence logic 14.

The preset values thus ascertained for each ink zone 10, 11 then are supplied to the applicable inking mechanism of the printing press 1, in order to preset the ink metering elements therein which are in the form of ink control sliders or ink doctor segments. As indicated, the ink presetting according to the present invention is substantially more exact when compared with the known art, so that there is less scrap and a shorter initial or run-in printing phase.

The corrected scanning information output from computer 3 is also transmitted to non-uniform inking computer 17 which then provides a signal to the printer 1 to control the spreading of the ink to be applied by rubbing the ink, e.g. a reciprocating roller system, in two dimensions (X and Y directions). In other words, inker roller 21 which is an axially oscillating roller is, for instance, controlled with respect to its phase position, in other words the onset of the axial displacement, in its stroke and in the reciprocation frequency in order to distribute the ink to be applied to the X and Y directions. The signal from non-uniform inking computer 17 modifies the action of the inker oscillator roller 21. Taking into account the scanned values from which the subject to be printed can be approximately derived, the ink to be applied to a printing plate (not shown) of the printing press 1 is thus distributed, preferably by means of a roller 21 in the X and Y direction during the inking process, thereby avoiding a striping or non-uniform inking effect.

Further improvements in the presenting of the ink metering elements is obtained with the aid of a subject computer 20, which receives an output from ink detection supply computer 3. Computer 20 provides a signal to printer 1 which modifies the contact times and durations of an applicable ink ductor 22 of an inking mechanism (not shown in further detail). Ink supply can thus be controlled in terms of its contact with the next adjacent inking mechanism roller. The result is a desirable influence on the ink distribution in the Y direction, particularly in combination with the rubber 21 controlled in accordance with the present invention. Thus, not only is the ink supply needed per inker zone taken into account, as in the known systems, but also the particular location, for instance within one ink zone; that is, by controlling the oscillating roller 21 and/or ink ductor 22, the ink is correctly placed and rubbed even in the circumferential direction of the plate 24, see arrow 26 in FIG. 3.

Instead of scanning printer's copies 8, 9, it is also possible within the scope of the present invention to use use information from an electronic picture or image memory 19 of FIG. 1 in which picture information in form of pixels specified by an electronic image processing system are present, as starting values for ascertaining the zonal presettings. German Patent Disclosure Document DE-OS 38 04 491 already discloses the evaluation of such picture information (pixels) in order to calculate mean density values. In the prior art this requires very large memories—on a scale that is practically unavailable—with complex processing logic. Within the scope of the present invention, it is therefore advantageous that such picture information can be compressed, that is, combined into larger surface units, for instance in the order of magnitude of the dot size of the scanning pattern area 7; and these values in turn can be further processed by using assigned correction factors.

In the present invention, the printed images produced by the printing press 1 are scanned, for example densitometrically or colorimetrically. The values obtained from this can be fed back, using a printing material scanning logic 18 with a self-learning system or a so-called expert or optimizing system, to the ink supply detection computer 3, so that the preset values can, continuously, be made still more precise during the initial run-on printing phase and even during the continued printing phase. The broken-line connections show the interconnection of the elements which form a suitable, though not required expansion of the system.

The method according to the present invention also makes it possible to take into account the unavoidable accumulation of ink in the printing mechanism, resulting from the passage of a cylinder groove. The starting points of the ductor or ductor roller 22 can be adjusted to the traversing of the oscillator 21 can be controlled between the beginning and end of printing. Thus the effect of uneven ink distribution in the printing direction can be reduced or eliminated, taking into account the subject to be printed.

Figure 2:
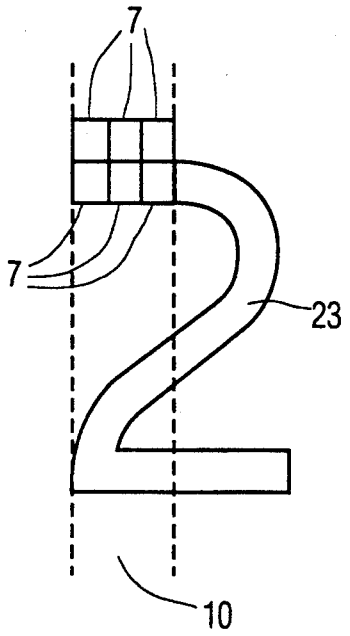
FIG. 2 shows a printing subject, in the form of a numeral 2.

FIG. 2 shows a subject 23 in the form of a numeral 2. It can be seen from this view that within a schematically indicated inker zone 10, a relatively large number of scanning spots or areas can be located, as indicated at 7, because in accordance with the present invention the scanning pattern 7 is smaller, preferably substantially smaller, than the width of the inker zone 10 (the scanning pattern being 2.5 mm×2 mm). Thus substantially finer detection of the areas being printed and those not being printed within an ink zone can be performed; that is, these areas are broken into arranged in quasi-checkerboard-like fashion.

Figure 3:
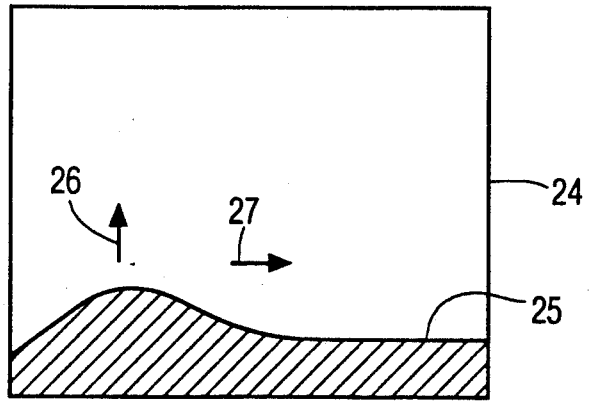
FIG. 3 shows an ink profile furnished by the inking mechanism, which is evened out in the X and Y direction, in other words under two-dimensional control, in the manner according to the present invention, as a function of the ascertained and previously corrected scanning values.

FIG. 3 shows a so-called ink mound or ridge 25 on a printing plate 24. According to the present invention this mound can be placed, or applied and displaced in the direction of the arrow 26 (Y direction) and in the direction of the arrow 27 (X direction) in the manner described above, using the controlled rollers 21, 22 so that in comparison with the prior art a substantial improvement of the inking as a function of the subject to be printed is obtained.

The presetting and control data ascertained or corrected by the weighting computer 16 can be displaced visually, for instance on a screen 30, or in the form of a log.

A further feature of the present invention provides that the weighting computer 16, the subject computer 20 and the striping correction computer 17 on the one hand control the printer 1, while a feedback path including a self-learning or optimizing system 18 in turn feeds information back to computer 3 which in turn changes the output supplied from computer 3 to computer 20 and 17. The self-learning or optimizing system can also store information from previous jobs in memory with all the automatic and manual settings and corrections for repeated jobs and on the basis of the corrections can modify the control parameters in the weighting computer 16, subject computer 20 and non-uniform inking or striping correction computer 17.

Various changes and modifications may be made, and any features described herein may be used with any of the others, within the scope of the inventive concept.

We claim:

1. A method for controlling the ink supply in a rotary printing machine, wherein said printing machine has ink supply setting means (2) for controlling the supply of printing ink to a printing plate (24) within predetermined axial zones (10, 11), and sensing means (4; 5, 5', 6, 6') are provided for sensing the subject matter (23) to be printed, and for obtaining electrical signals representative of the distribution of the subject matter in the respective zones (10, 11), and further a computation means (3, 15, 16, 17, 18, 19, 20) for processing the signals from the sensing means and controlling the ink sensing means (2), said method comprising generating separate sensed signals representative of individual colors of the subject matter (23) within individual predetermined sensing spots or areas (7), which have a finite width (X) smaller than the width of the zones (10, 11) and a finite height (Y), in an X-Y coordinate system;

weighting, based on a controlled weighting factor, the received separate sensed signals and applying weighting correction factors to said separate sensed signals representative of the subject matter within the scanned spots in said coordinate system, and then, after applying said correction factors, summing the individually weighted correction signals fro any one color, in the respective entire zone, and controlling the ink supply of the respective colors in the respective zone in accordance with the weighted and then summed sensed signal, to thereby compensate for, or avoid interference of different colors upon over-printing in said predetermined zones by said printing machine.

2. The method of claim 1, comprising the additional step of detecting the positional coordinates (X, Y) of the scanning pattern (7) and then weighting, prior to zonal summing up, the area coverage ascertained by the scanning pattern (7).

3. The method of claim 1, wherein said step of weighting said signals comprises weighting said signals based on parameters of printing characteristics including at least one of:

position of a cylinder groove;

paper characteristics;

ink characteristics;

composition of a damper fluid;

printing speed;

ink penetration into a substrate.

4. An apparatus for controlling the ink supply in a printing machine (1), said printing machine having ink supply setting means (2) for controlling the supply of printing ink to a printing plate (24) within predetermined inking zones (10, 11), sensing means (4,5,5', 6,6') for sensing the subject matter (23) to be printed and for obtaining electrical signals representative of distribution of subject matter in the respective zones (10, 11); and computation means (3, 15, 16, 17, 18, 19, 20) for processing signals from the sensing means and controlling the ink setting means (2), wherein, in accordance with the invention, the sensing means (4-6) include means (5,5', 6,6') for providing separate sensed signals representative of individual colors of the subject matter (23) within predetermined sensing spots or areas at identical locations of the subject matter (23) to be printed, which have width (X) smaller than the width of the respective zones (10, 11) and a predetermined height (Y) in the respective zone, within an X-Y coordinate system;

and wherein said computation means includes a weighting computer (16) having a controllable input device (15), said weighting computer being coupled to the sensing means and providing an output to said ink setting means, said weighting computer (16) applying weighting or correction factors under control of said input device to the separate sensed scanned signals representative of the subject matter of the separately scanned spots in said coordinate system and then, after application of said correction factors, summing the individual weighted or corrected signals delivered from the respective signal providing means (5, 6) upon sensing the entire zone, said ink supply sensing means (2) being controlled by the weighting computer (16) for control of the ink supply setting in accordance with the weighted, corrected and summed signals in any one zone to provide for setting of ink supply in accordance with sensed identical X-Y coordinates of any sensed spot or area with respect to the individual colors and control of said ink supply setting means in accordance with the weighted and corrected sensed signals to thereby provide for compensation, or avoidance of interference of different color inks to be overprinted above each other by the printing machine.

5. The apparatus of claim 4, wherein said computation means includes an X-Y coordinate detection circuit (12) for detecting the position of the sensed signal providing means (5, 6) and hence of the sensing spots or areas (7) in said X-Y coordinate system, to permit association of the position of scanned spots of the respective sensed signals received from said signal providing means (5,5', 6,6').

6. The apparatus of claim 4, wherein said printing machine includes a ductor roller (22) for intermittently supplying ink to said printing plate (23);

and wherein said computation means (3, 15, 16, 17, 18, 19, 20) includes a subject computer (20) coupled to and controlled by the output from the weighting computer for controlling at least one of:

contact time;

duration of ink supply by said ductor roller.

7. The apparatus of claim 4, wherein said printing machine includes at least one reciprocating or oscillating inker roller (21); and wherein said computation means (3, 15, 16, 17, 18, 19, 20) includes a non-uniform inking computer (17) coupled to said weighting computer (16) and controlling at least one of:

phase position;

frequency;

stroke, of said reciprocating roller (21) in accordance with the inking profile in the X-Y coordinate system (26, 27) of the subject matter (23).

8. The apparatus of claim 4, wherein said printing machine includes a ductor roller (22) for intermittently supplying ink to said printing plate (23);

wherein said printing machine further includes at least one reciprocating or osciallating inker roller (21); and wherein the computation means (3, 15, 16, 17, 18, 19, 20) comprises control means (17, 20) controlling at least one of:

said ductor roller (22), and said oscillating roller (21) for control of ink supply upon passage of a cylinder groove of said printing machine to prevent ink accumulation upon passage of the cylinder groove upon rotation of the cylinder of the rotary printing machine.

9. The apparatus of claim 4, further including a self-learning or optimizing system (18) and a feedback loop from the rotary printing machine (1) to said computation means for modifying the output signals being applied to said ink supply setting means and for modifying the corrections in accordance with actural printing processes occurring in said printer, and for storing said correction factors.

10. The apparatus of claim 4, wherein said computation means includes a non-uniform inking computer (17) controlling operating characteristics of an oscillating roller (21) of the printing machine, a subject computer (20) controlling an ink ductor roller (22) of the printing machine; and a self-learning computer (18) coupled to sense actual operating conditions of the printing machine;

and further including interconnections between said weighting computer, siad non-uniform inking computer, said subject computer and said self-learning computer (18), to form an integrated self-correcting or self-learning optimizing systems;

and wherein said computation means includes storage means storing correction factors being applied to the output signals from said weighting computer for subsequent modification of output signals derived from said weighting computer (16) under control of said input device.

11. The apparatus of claim 4, wherein the scanning spot or area (7) has a dimension of about 2 mm by 2.5 mm;

wherein the width of any one of said inking zones (10, 11) is between about 20 and 60 mm;

and wherein a plurality of separate sensed signal providing means (5,5', 6,6') are provided, positioned transversely across said zones, next to each other.

12. The apparatus of claim 4, further including a picture or image memory (19) coupled to said computation means (3, 15, 16, 17, 18, 19, 20) for supplying area coverage data or pixels for modification or correction of output signals applied by said weighting computer to said ink supply setting means.

13. The apparatus of claim 4, further including display means (30) coupled to the weighting computer (16) for displaying the output signals being applied to said ink supply setting means (2).

14. The apparatus of claim 4, wherein said printing machine is an offset printing machine.

15. The apparatus of claim 4, wherein the printing machine has a printing plate.

16. The apparatus of claim 4, wherein the printing machine is an offset printing machine and has a printing plate (24).

17. The apparatusa of claim 6, wherein said printing machine is an offset printing machine.

18. The apparatus of claim 7, wherein said printing machine is an offset printing machine.

19. The apparatus of claim 8, wherein said printing machine is an offset printing machine.

* * * * *